United States Patent [19]

Kadowaki et al.

[11] Patent Number: 4,618,570

[45] Date of Patent: Oct. 21, 1986

[54] SILVER HALIDE PHOTOGRAPHIC MATERIALS

[75] Inventors: Takashi Kadowaki; Kaoru Onodera, both of Odawara, Japan

[73] Assignee: Konishiroku Photo Industry Co., Ltd., Tokyo, Japan

[21] Appl. No.: 712,342

[22] Filed: Mar. 15, 1985

[30] Foreign Application Priority Data

Mar. 27, 1984 [JP] Japan ..... 59-60421
Mar. 28, 1984 [JP] Japan ..... 59-61396

[51] Int. Cl.[4] ..... G03C 1/40; G03C 1/30; G03C 1/02

[52] U.S. Cl. ..... 430/505; 430/584; 430/626; 430/521; 430/570; 430/603; 430/604; 430/605; 430/599

[58] Field of Search ..... 430/584, 626, 521, 570, 430/550, 505, 603, 599, 604, 605

[56] References Cited

U.S. PATENT DOCUMENTS

| | | | |
|---|---|---|---|
| 2,865,752 | 12/1958 | Saunders et al. | 430/521 |
| 3,325,287 | 6/1967 | Yamamoto et al. | 430/626 |
| 3,575,704 | 4/1971 | Salesin | 430/521 |
| 3,615,644 | 10/1971 | Gotze et al. | 430/584 |
| 3,701,664 | 10/1972 | Piller et al. | 430/623 |
| 3,881,933 | 5/1975 | Kumai et al. | 430/626 |

*Primary Examiner*—Won H. Louie
*Attorney, Agent, or Firm*—Frishauf, Holtz, Goodman & Woodward

[57] ABSTRACT

A silver halide photographic material having at least one layer of silver halide emulsion layers containing a silver halide having a silver chloride content of not less than 25 molar %, characterized in that at least one of said silver halide emulsion layers contains a silver halide sensitized with a compound having the following formula (Ia), and/or a compound having the following formula (Ib) and is hardened with a compound having the following formula (II) and/or a compound having the formula (III);

(Ia)

(Ib)

(II)

(III)

in the above formulae (Ia), (Ib), (II) and (III), $R_1$ to $R_{20}$, $Z_1$ and $Z_2$, $n_1$ and $n_2$, Q and Q', L, p and q are defined in the specification.

The photographic material of the invention not only shows a higher sensitivity, a lower infrared sensor fogging, a superior sharpness or color reproductivity and a superior whiteness but also exerts a good storage property with time or a lower change in sensitivity after storage.

16 Claims, No Drawings

SILVER HALIDE PHOTOGRAPHIC MATERIALS

BACKGROUND OF THE INVENTION

This invention relates to a silver halide photographic material and, more particularly, it is concerned with a color photographic material for printing.

In a color photographic material for printing, red-sensitive, green-sensitive and blue-sensitive emulsion layers receive information from a negative film through an exposure mean according to three color separation as is well-known and color reproduction is effected by color reaction of cyan, magenta and yellow couplers contained in the respective emulsion layer with oxidized color developing agent.

Of these emulsion layers, strength of color sensitization, spectral distribution, sensitized terminal should be reviewed in a red-sensitive emulsion layer. Dyes for spectral sensitization of a red-sensitive emulsion have the important functions of spectral sensitization effect, spectral sensitization wave length and development of fogging and so on and studies have been made on such dyes as cyanine, merocyanine, complex merocyanine dyes. In particular, a dicarbocyanine dye having a cyclohexene ring shows superior functions as mentioned above and practical technique of said dicarbocyanine dye is disclosed, for example, in Japanese Patent Pubication No. 10473/1971, Japanese Patent Laid-open Application Nos. 5035/1975, 151026/1977, 23520/1979 and 7629/1983 and others. However, said dicarbocyanine dye has presented the two big problems. Namely, the one is storage property with time after preparation of a silver halide photographic material up to its use and a great desensitization has been realized with lapse of time. The prior art as recited above has attempted to make an improvement therein, but satisfactory results could not be obtained yet; while the other is infrared sensor fogging or sensitive fogging which has been brought about from an infrared ray-sensitive sensor recently and frequently applied during production steps or automated steps such as a printer for a photographic material, a processing apparatus and the like. Emission wave length from said infrared ray-sensitive sensor may vary depending upon the the emission source applied, but representative infrared ray emission diode of a Ga-As epitaxial type provides 900 to 950 nm, the same type using Si does approximately 1140 nm and the same type using Ge does approximately 1880 nm. Especially, dicarbocyanine dye is much more apt to undergo said infrared sensor fogging and, as countermeasures, various studies have been made on a filter dye, an antifoggant and a layer construction in a photographic material, with unsatisfactory results.

Apart from the aforesaid problems, there has been also presented another problem with regard to a hardening agent.

As the binder for a photographic material, there has been mainly utilized a gelatin and a hardening agent has been also used together with said binder. Characteristics for said hardening agent are a rapid hardening effect, no adverse influence upon a silver halide such as fogging and others, no labour sanitary and environmetal polution problems, water-solubility and so on, with easy synthesis and inexpensive production cost. In view of the above, studies have been made on hardening agents of vinylsulfone, ethyleneimine, epoxy, N-methylol and cyanuricchloride types and a cyanuricchloride type hardening agent shows superior properties meeting almost all of the aforesaid characteristics, as disclosed in U.S. Pat. Nos. 3,325,287 and 4,076,538 and Japanese Patent Laid-open Application Nos. 19220/1973, 60612/1977, 128130/1977, 130326/1977, 1043/1981 and 40244/1982. However, it has been that the cyanuric-chloride type hardening agent has a great disadvantages; namely, storage property with time is poor in a photographic material using said hardening agent to produce a high desensitization with time and an even less effect could be accomplished by the use of a desensitization retarder or a desensitization retarder may be apt to induce fogging. Moreover, storage property with time would become remarkably poor when used together with said dicarbocyanine dye having a cyclohexene ring.

With particular reference to a color photographic material for printing, if a higher sensitivity is given in said color photographic material, it is advantageous in workability for printing to reduce a time for printing, and a small difference in sensitivity with lapse of time or among lots would be desirable for a printing yield.

Under these circumstances, chemical or spectral sensitization methods have been studied on a silver halide emulsion, while the subject silver halide has also been studied so that a silver halide having a high silver chloride content may be the subject to be highly sensitized by spectral sensitization. However, the silver halide with a high silver chloride content would be readily subjected to fogging, particularly, for instance, in a high temperature rapid processing or upon storage with time, which leads to inferior image quality in a print.

On the other hand, one of the important properties of a photographic material for printing is sharpness, which may have influence upon an image quality of a print, and then various studies have been made for improvement on an antiirradiation dye, a layer construction, a base and the like. Another important property is color reproductivity and studies have also been made on a spectral sensitizing dye or filter dye. Therefore, characteristics of the antiirradiation or filter dye should be important as they may influence upon both properties as noted above; more illustratively, said characteristics are an excellent spectral absorption property, an excellent elution property in developing process and no adverse influence upon a silver halide such as reduced sensitivity or induced fogging.

As the dye meeting almost all of the above requirements for characteristics, there may be mentioned, for example, oxonol, azo and anthraquinone dyes and, inter alia, those anthraquinone dyes are superior in a prominent spectral absorption property, as disclosed in U.S. Pat. No. 2,865,752 and Japanese Patent Laid-open Application No. 33825/1973. However, the anthraquinone dye may readily induce fogging to a silver halide emulsion, which is remarkable in the silver halide emulsion with a high silver chloride content. If an antifoggant or a stabilizer is added for avoiding, a great desensitization would be induced.

Moreover, a hardening agent has a property to reduce an elution property of the antiirradiation or filter dye in developing process, which leads to inferior whiteness of a print.

This invention has been completed in view of the present circumstances as discussed hereinabove. The objects of this invention are to provide a photographic material which shows a lower infrared sensor fogging, a superior sharpness or color reproductivity and a superior whiteness, to provide a photographic material which exerts a good storage property with time or a less change in sensitivity after storage and also to provide a photographic material having a higher sensitivity.

SUMMARY OF THE INVENTION

The above-mentioned objects have been satisfactorily accomplished by the present invention.

According to this invention, there is provided a photographic material having at least one of silver halide emulsion layers containing a silver halide with a silver chloride content of not less than 25 molar %, characterized in that at least one of said silver halide emulsion layers contains a silver halide sensitized with a compound having the following formula (Ia), and/or a compound having the following formula (Ib), and is hardened with a compound having the formula (II) and/or a compound having the formula (III);

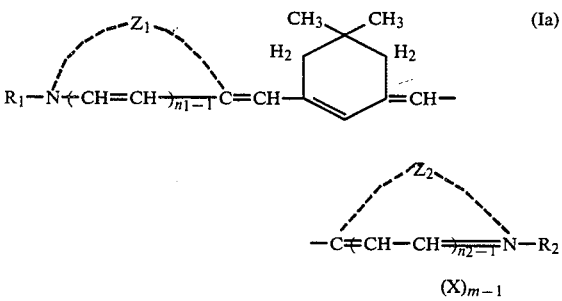

(Ia)

(wherein $R_1$ and $R_2$ individually represent an alkyl group; $Z_1$ and $Z_2$ represent a nonmetallic atom group required for completion of a 5- or 6-membered nitrogen-containing heterocyclic ring; X is an anion; $n_1$ and $n_2$ are 1 or 2; m is 1 or 2 provided that, when an inner salt is formed, m is 1),

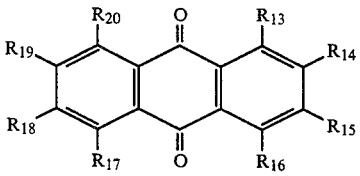

(Ib)

(wherein $R_{13}$, $R_{16}$, $R_{17}$ and $R_{20}$ individually represent a hydroxy group, a group of -OR or a group of

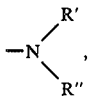

in which R is an alkyl group or an aryl group and R′ and R″ represent a hydrogen atom or an alkyl or aryl group having at least one sulfonic acid or carboxylic acid group; $R_{14}$, $R_{15}$, $R_{18}$ and $R_{19}$ individually represent a hydrogen atom, a carboxylic acid group, a sulfonic acid group or an alkyl or aryl group having at least one sulfonic acid group or carboxylic acid group),

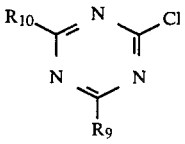

(II)

(wherein $R_9$ is a chlorine atom, a hydroxy group, an alkyl group, an alkoxy group, a group of

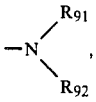

in which $R_{91}$ and $R_{92}$ individually represent a hydrogen atom, an alkyl group or an aryl group, a group of —NHCOR$_{93}$, in which $R_{93}$ is a hydrogen atom, an alkyl group, an aryl group or an alkylthio group, or a group of —OM, in which M is a monovalent metal atom; and $R_{10}$ is the same as $R_9$ except for a chlorine atom),

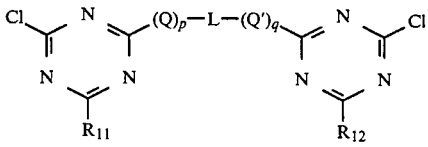

(III)

(wherein $R_{11}$ and $R_{12}$ individually represent a chlorine atom, a hydroxy group, an alkyl group, an alkoxy group or a group of —OM, in which M is as defined above; Q and Q′ represent a linking group of —O—, —S— or —NH—; L is an alkylene group or an arylene group; p and q are 0 or 1).

DESCRIPTION OF PREFERRED EMBODIMENT

Definitions of the above formula (Ia) will be merely illustratively explained below.

In the formula, an alkyl group represented by $R_1$ or $R_2$ may be, for example, a methyl, ethyl or propyl group and may be also substituted, for example, a chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfatepropyl, allyl or benzyl group and the like. A 5- or 6-membered nitrogen-containing heterocyclic nucleus formed by $Z_1$ and $Z_2$ may be, for example, a thiazoline, oxazoline, selenazoline, thiazole, selenazole, oxazole, benzothiazole, benzooxazole, benzimidazole, 3,3-dialkylindolenine, naphthothiazole, naphthooxazole, naphthoselenazole, thienothiazole, 2-pyridine, 4-pyridine, 2-quinoline or 4-quinoline nucleus and the like.

An anion represented by X may be, for example, $Cl^-$, $Br^-$, $I^-$,

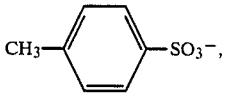

$CH_3SO_4^-$, $C_2H_5SO_4^-$ and the like.

Illustrative examples of sensitizing dye represented by the formula (Ia) are as recited below.

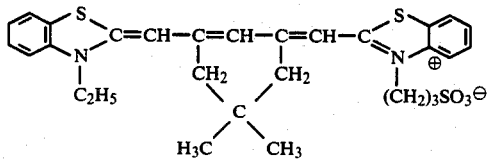
(Ia-1)
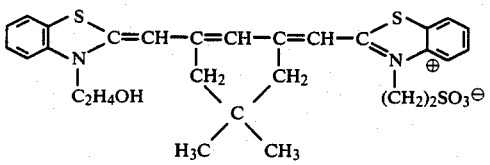
(Ia-2)
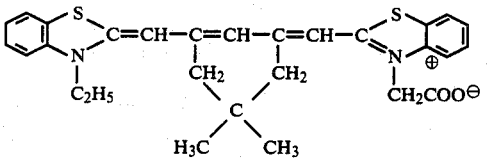
(Ia-3)
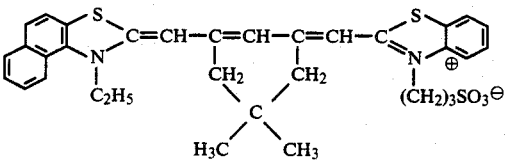
(Ia-4)
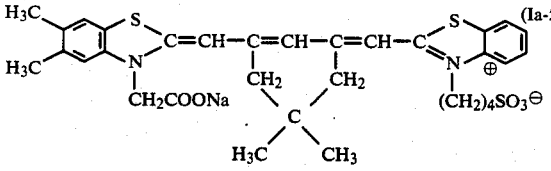
(Ia-5)
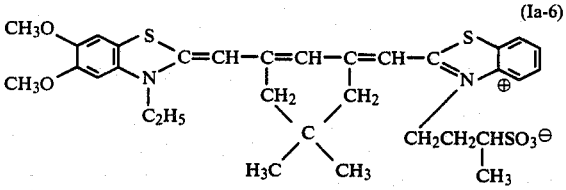
(Ia-6)
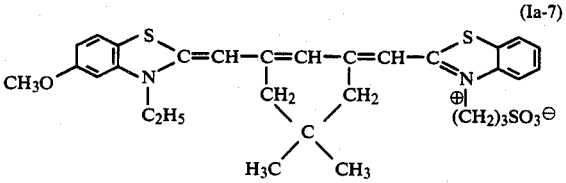
(Ia-7)
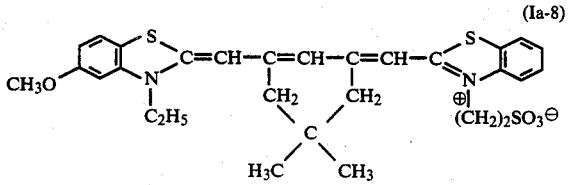
(Ia-8)
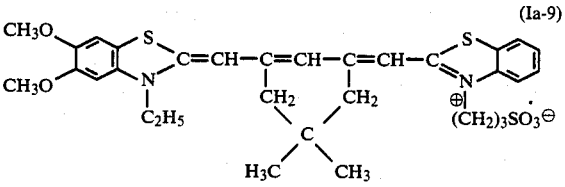
(Ia-9)
-continued
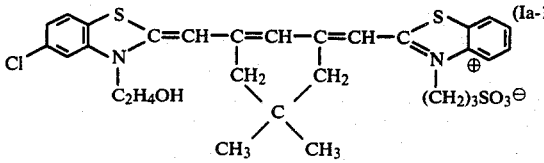
(Ia-10)
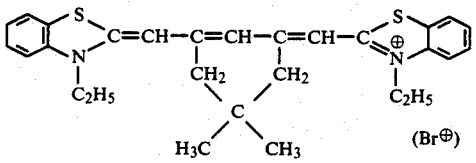
(Ia-11)
(Br⊕)
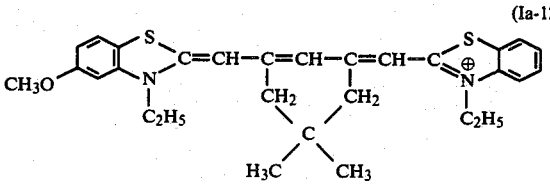
(Ia-12)
(CH3—⊖—SO3)
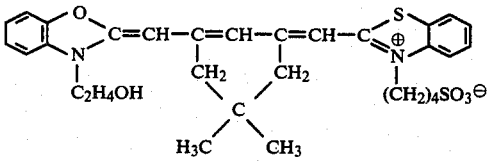
(Ia-13)
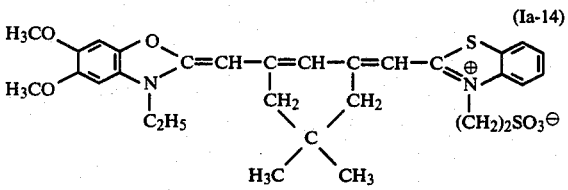
(Ia-14)
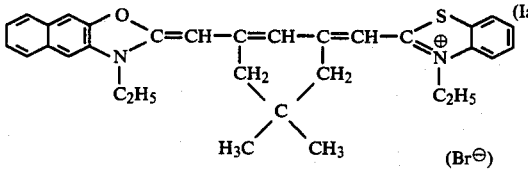
(Ia-15)
(Br⊖)
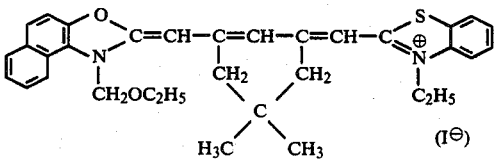
(Ia-16)
(I⊖)
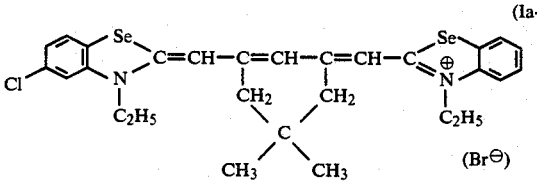
(Ia-17)
(Br⊖)

-continued (Ia-18)

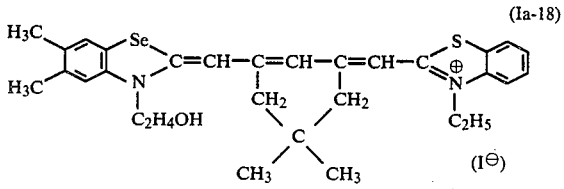

(Ia-19)

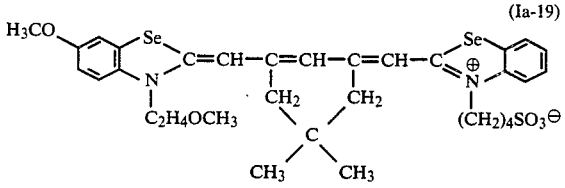

(Ia-20)

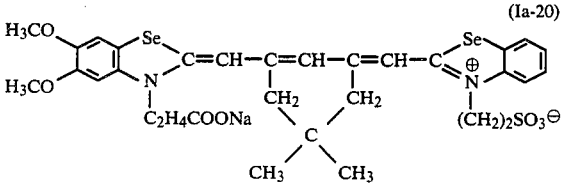

(Ia-21)

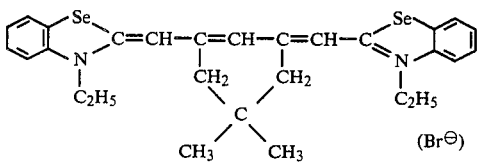

The sensitizing dye which may be employed in this invention is not restricted to the above-recited dyes, but there may be optionally selected and employed any of sensitizing dyes, which may meet the standard for the above sensitizing dyes of this invention, from those disclosed, for example, in U.S. Pat. Nos. 3,457,078, 3,436,222, 3,635,721, 3,615,632 and 4,046,572 and British Pat. No. 1,210,953.

In order to incorporate into a photosensitive material, the sensitizing dye to be employed in this invention may be dissolved in water or a water-miscible organic solvent such as methanol, ethanol, a fluorinated alcohol, 1,4-butanediol, dimethylformamide, dioxane, benzene, chloroform, pyridine, ligroin, acetone, triethylene glycol monomethyl ether, triethanolamine, methyl cellosolve, ethyl cellosolve, phenyl cellosolve and the like and then the resulting solution may be added to a silver halide emulsion. The dye may be used alone or in combination with the two or more.

The compound represented by formula (Ia) may be used in an amount of $1\times10^{-3}$–$1\times10^{-5}$ mole per one mole of silver halide.

In the above formula (Ib), R in the —OR group represented by $R_{13}$, $R_{16}$, $R_{17}$ and $R_{20}$, when it is an alkyl group, may be, for example, a methyl, ethyl or butyl group and, when it is an aryl group, may be, for example, a phenyl group. In the —NR'R" group, an alkyl group having at least one of a sulfonic acid or carboxylic acid group represented by R' and R" may be, for example, $—CH_2SO_3H$, $—(CH_2)_2SO_3H$, —CHCOOH-, $—(CH_2)_2COOH$ or a sodium, potassium or ammonium salt thereof. An aryl group represented by R' or R" may be, for instance,

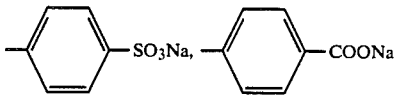

and the like.

Also, an alkyl or aryl group having at least one of a carboxylic or sulfonic acid group represented by $R_{14}$, $R_{15}$, $R_{18}$ and $R_{19}$ may be the same as recited with regard to R' and R".

The compound (Ib) may be incorporated into at least one layer or plural layers selected from the above emulsion layers or auxiliary layers for irradiation protection or filter effect. Preferably, the compound may be incorporated into the red-sensitive emulsion layer or the adjacent auxiliary layer to the said red-sensitive emulsion layer. The compound (Ib) may be usually used by dissolving it in water or an alcohol. An amount of the compound to be added is 1–100 mg/m², preferably 5–50 mg/m² in a photosensitive material.

Illustrative examples of the compound (Ib) are as recited below.

(Ib-1)

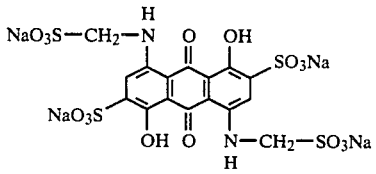

(Ib-2)

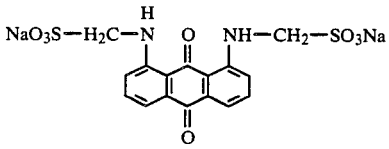

(Ib-3)

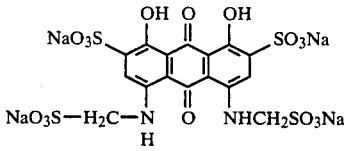

(Ib-4)

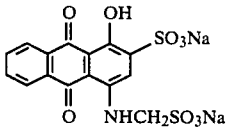

(Ib-5)

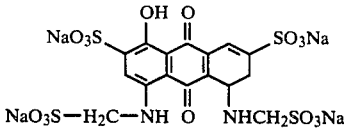

(Ib-6)

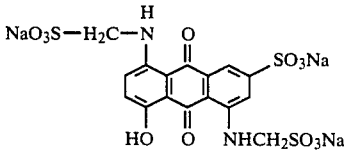

(Ib-7)

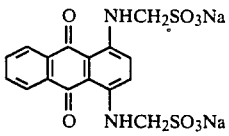

-continued (Ib-8)

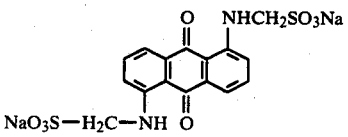

(Ib-9)

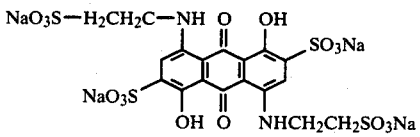

(Ib-10)

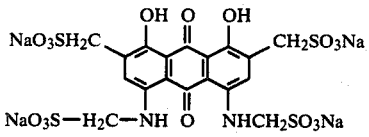

(Ib-11)

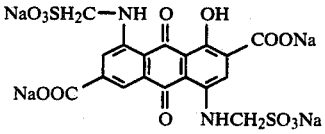

(Ib-12)

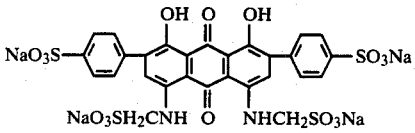

(Ib-13)

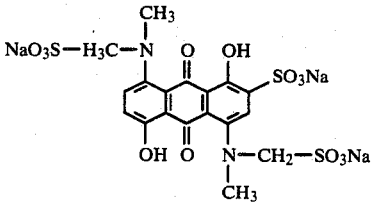

(Ib-14)

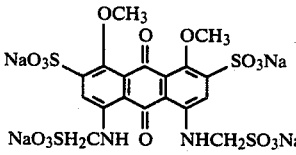

(Ib-15)

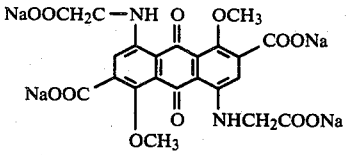

(Ib-16)

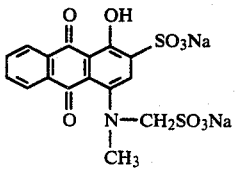

(Ib-17)

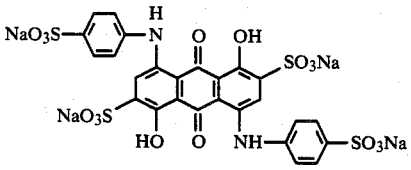

-continued (Ib-18)

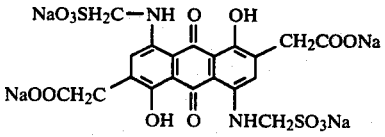

(Ib-19)

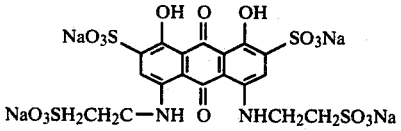

In the above formula (II), an alkyl group represented by $R_9$ or $R_{10}$ may be, for example, a methyl, ethyl or butyl group and the like and an alkoxy group may be, for example, a methoxy, ethoxy or butoxy group and the like.

Illustrative example of the

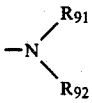

may be $—NH_2$, $—NHCH_3$, $—NHC_2H_5$ and the like and illustrative example of the $—NHCOR_{93}$ may be $—NHCOCH_3$,

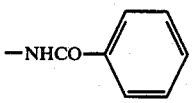

and the like. In the —OM group represented by $R_9$ or $R_{10}$, M may be, for example, a sodium or potassium atom and the like.

The cyanuric chloride type hardening agent (II) may be disclosed, for example, in U.S. Pat. Nos. 3,645,743, 3,325,287, 3,701,664, 3,881,933 and 4,076,538 and may be applied from the above-mentioned agents in the light of the above standard.

In the above formula (III), an alkyl group represented by $R_{11}$ or $R_{12}$ may be, for example, a methyl, ethyl or butyl group and the like and an alkoxy group may be, for example, a methoxy, ethoxy or butoxy group and the like. In the —OM group, M may be, for example, a sodium or potassium atom and the like. An alkylene group represented by L may be, for example, $—CH_2—$, $—(CH_2)_2—$, $—(CH_2)_3—$ and the like and an arylene group may be, for example, a p-, o- or m-phenylene group and the like.

The cyanuric chloride type hardening agent (III) may be, for example, disclosed in Canadian Pat. No. 895,808, U.S. Pat. No. 4,402,755 and may be selected and employed from the above agents in the light of the above standard.

The compound of the formula (II) or (III) in this invention may be incorporated into at least one layer or plural layers selected from the present emulsion layers or auxiliary layers. This compound may be added to any optional one layer to harden the other layer(s) after having been diffused thereto at the time of coating thereof. It may be dissolved in water or an alcohol, e.g., methanol, ethanol and the like and added at 1 to 100 mg per g of gelatin or preferably 5 to 50 mg/g of gelatin.

Illustrative examples of the compound (II) or (III) may be shown below, but they are not intended to limit the present invention.

Compound (II)

(II-1)

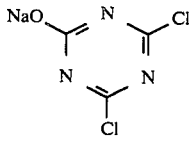

(II-2)

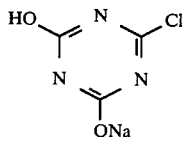

(II-3)

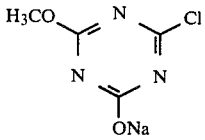

(II-4)

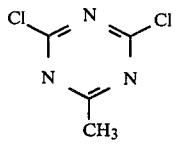

(II-5)

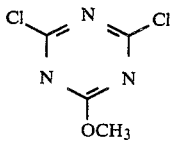

(II-6)

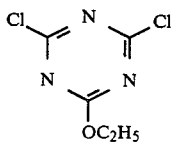

(II-7)

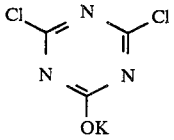

(II-8)

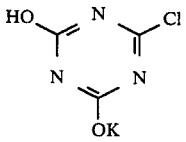

(II-9)

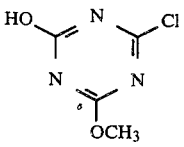

(II-10)

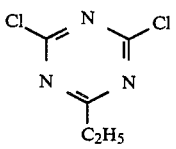

(II-11)

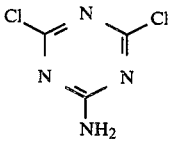

(II-12)

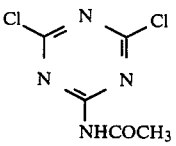

(II-13)

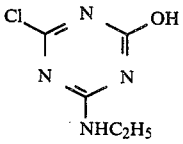

Compound (III)

(III-1)

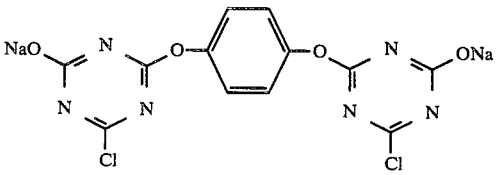

(III-2)

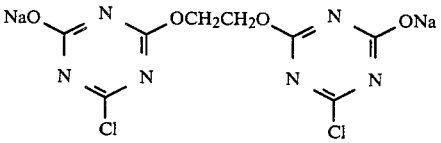

-continued

Compound (III)

(III-3)

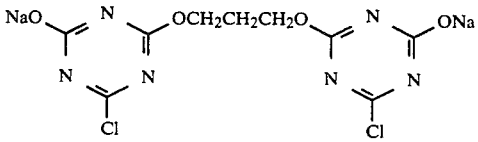

(III-4)

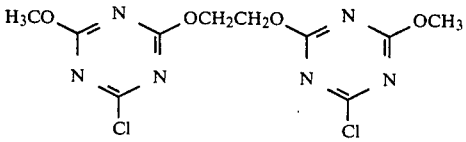

(III-5)

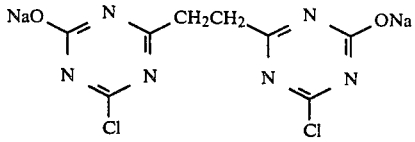

(III-6)

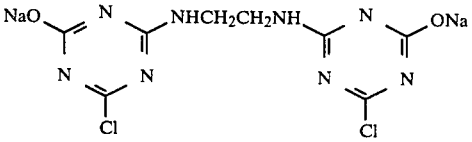

(III-7)

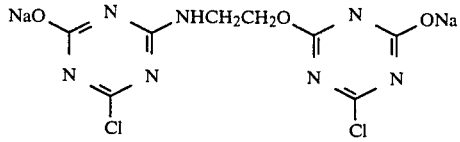

(III-8)

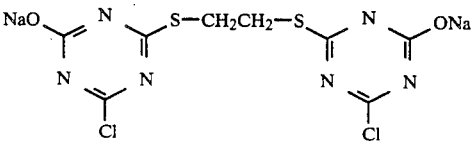

(III-9)

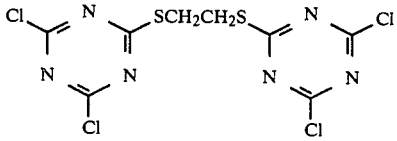

(III-10)

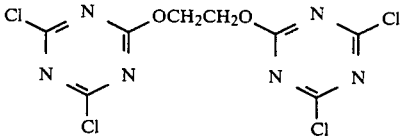

In the present photosensitive material, the silver halide contained in at least one emulsion layer is a silver halide containing not less than 25 molar % of silver chloride and the remaining silver halide is composed of silver bromide and silver iodide. Preferably, silver bromide is 0 to 75 molar % and silver iodide is 0 to 5 molar %, particularly a silver halide having silver chloride of 25 to 60 molar % and silver bromide of 40 to 75 molar % is preferable.

Emulsion layers of this invention may be all layers composed of the above-mentioned silver halides and all of them may not necessarily be those emulsion layers. Any optional silver halide formulation may be selected depending upon required properties.

These silver halide grains may be coarse or fine and a distribution of grain size may be wide or narrow.

Also, crystals of these silver halide grains may be normal or twin and any ratio of (100) surface to (111) surface may be employed. Moreover, crystalline structure of the silver halide grain may be uniform from the interior up to the exterior or of a differnt layer structure in the interior and the exterior. Also, the silver halide grain may be of a type which a latent image may be mainly formed on the surface thereof or of a type which a latent image may be formed within grain. The silver halide may be any of those prepared according to the neutral method, the ammonia method or the acid method. Also, there may be applied any of silver halide grains prepared according to any of the simultaneous mixing method, the normal mixing method, the reverse mixing method, the conversion method and others. Grain size is preferably in the range of 0.1 to 1.0$\mu$.

In the present phosensitive material, it is preferable to remove soluble salts from the respective silver halide emulsions to be applied, but the unremoved emulsions may be also applied. Two or more silver halide emulsions separately prepared may be used in admixture therewith.

Silver halide photographic emulsion having dispersed silver halide grains in a binder liquid may be sensitized with a chemical sensitizing agent. The chemical sensitizing agents which may be advantageously employed in this invention are divided into four main classes of a noble metal sensitizing agent, a sulfur sensitizing agent, a selenium sensitizing agent and a reduction sensitizing agent.

As the noble metal sensitizing agent, there may be employed a gold, ruthenium, rhodium, palladium, iridium or platinum compound and the like. When the gold compound is to be used, ammonium thiocyanate or sodium thiocyanate may be used together.

As the sulfur sensitizing agent, there may be used an active gelatin or a sulfur compound.

As the selenium sensitizing agent, there may be used an active or inert selenium compound.

As the reduction sensitizing agent, there may be used a stannous salt, a polyamine, a bisalkylaminosulfide, a silane compound, an iminoaminomethanesulfinic acid, a hydrazinium salt or a hydrazine derivative.

Further, in order to give photosensitivity in the desired photosensitive wave length range, optical sensitization to the silver halide emulsion may be effected by the combined use of the above dicarbocyanine dye having said cyclohexene ring or by the use of separate, various sensitizing dyes where a different colorsensitivity is seen from said dicarbocyanine dye. Preferable sensitizing dye which may be employed in this instance may include, for example, a cyanine dye, a merocyanine dye or a complex cyanine dye alone or in admixture with the two or more. Such various optical sensitizing agents may be applied for different purposes from their original purposes, e.g., for prevention of fogging, prevention of a silver halide color photosensitive material from lowered photographic performance during storage, control of development, e.g., control of gradation and others.

In the constructive layers of the present photosensitive material, a chemical sensitizing agent such as a thioether compound, a quaternary ammonium salt compound, or a polyalkylene oxide compound, a stabilizer such as a triazole, an imidazole, an azaindene, a benzothiazolium compound, a zinc compound, a cadmium compound or a mercaptan compound may be also employed where necessary to such an extent that effect of this invention would not be adversely affected.

Where the present invention is to be applied to a color photosensitive material, there may be used a non-diffusion coupler capable of being coupled with an aromatic primary amine developing agent for coloration.

As the yellow dye image-forming coupler, there may be used a 4 equivalent or 2 equivalent coupler of an acylacetamide or benzoylmethane type; these couplers are disclosed, for example, in U.S. Pat. Nos. 2,778,658, 2,875,057, 2,908,573, 3,227,155, 3,227,550, 3,253,924, 3,265,506, 3,277,155, 3,241,331, 3,369,895, 3,384,657, 3,408,194, 3,415,652, 3,447,928, 3,551,155, 3,582,322, 3,725,027, German Patent Laid-open Application Nos. 15 47 868, 20 57 941, 21 62 899, 21 63 812, 21 62 899, 21 63 812, 22 13 461, 22 19 917, 22 19 917, 22 61 361, 22 63 875, Japanese Patent Publication No. 13576/1972, Japanese Patent Laid-open Application Nos. 29432/1973, 66834/1973, 10736/1974, 122335/1974, 28834/1975 and 132926/1975 and so on.

As the magenta dye image-forming coupler, there may be employed a 4 equivalent or 2 equivalent magenta dye image-forming coupler of a 5-pyrazolone, pyrazolotriazole, pyrazolinobenzimidazole, indazolone or cyanoacetyl type; these couplers are disclosed, for example, in U.S. Pat. Nos. 2,600,788, 3,062,653, 3,127,269, 3,311,476, 3,152,896, 3,419,391, 3,519,429, 3,558,318, 3,684,514, 3,888,680, 3,907,571, 3,928,044, 3,930,861, 3,930,866, 3,933,500, Japanese Patent Laid-open Application Nos. 29639/1974, 111631/1974, 129538/1974, 13041/1975, Japanese Patent Publication Nos. 47167/1978, 10491/1979, 30615/1980, British Pat. No. 1,247,493, Belgian Pat. No. 792,525, U.S. Pat. No. 3,061,432, German Pat. No. 2,156,111, Japanese Patent Publication No. 60479/1971, Belgian Pat. No. 769,116 and others.

As the cyan dye image-forming coupler, there may be employed a 4 equivalent or 2 equivalent cyan dye image-forming coupler of a phenol or naphthol type; these couplers are disclosed in, for example, U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763 3,839,044, German Patent Laid-open Application No. 21 63 811, 22 07 468, Japanese Patent Publication Nos. 27563/1964, 28836/1970, Japanese Patent Laid-open Application Nos. 37425/1972, 10135/1975, 25228/1975, 112038/1975, 117422/1975, 130441/1975 and Research Disclosure 1976, 14853.

In this invention, there may be also used an ultraviolet absorbing agent such as a benzophenone or benzoazole compound and others. Benzotriazole compounds are disclosed, for example, in Japanese Patent Publication Nos. 10466/1961, 26187/1967, 5496/1973, 41572/1973, U.S. Pat. Nos. 3,754,919, 4,220,711 and others.

The ultraviolet absorbing agent may preferably be incorporated in a layer provided on the uppermost emulsion layer viewed from the support.

Such hydrophobic additives as cyan dye-forming couplers, magenta dye-forming couplers, yellow dye-forming couplers or photographic additives, e.g., ultraviolet absorbing agents may be dispersed into an aqueous solution of a hydrophilic binder according to a well-known method and then incorporated into a silver halide emulsion layer or a nonphotosensitive auxiliary layer. As a method for dispersion of hydrophobic compounds, there may be applied a latex dispersion method or an oil-in-water dispersion method as disclosed, for example, in Japanese Patent Laid-open Application Nos. 74538/1974, 59943/1976, 32552/1979, Research Disclosure, 1976, August, No. 14850, pages 77–79 and so on. As the oil-in-water dispersion method, there may be applicable any well-known method for dispersing such hydrophobic compounds as couplers. Illustratively speaking, a hydrophobic compound is dissolved in a high boiling organic solvent with a boiling point of above 175° C. and, if required, a low boiling solvent, e.g., ethyl acetate, butyl acetate and the like, admixed with an aqueous solution containing a hydrophilic binder, e.g., gelatin containing a surface active agent and then emulsified and dispersed by means of a high speed mixer, a colloid mill, an ultrasonic apparatus and the like to incorporate into such a hydrophilic colloid layer as an emulsion layer or an auxiliary layer. As the high boiling organic solvent which may be employed in this case, there may be employed an organic acid amide, a carbamate, an ester, a ketone, a urea derivative, in particular, a phthalic acid ester, e.g., dimethyl phthalate, diethyl phthalate, dipropyl phthalate, dibutyl phthalate di-n-octyl phthalate, diisooctyl phthalate, diamyl phthalate, dinonyl phthalate, diisodecyl phthalate; a phosphoric acid ester, e.g., tricresly phosphate, triphenyl phosphate, tri-(2-ethylhexyl)-phosphate, trisnonyl phosphate; a sebacic acid ester, e.g., dioctyl sebacate, di-(2-ethylhexyl)sebacate, diisodecyl sebacate; a glycerol ester, e.g., glycerol tripropionate, glycerol tributyrate; an adipic acid ester, a glutaric acid ester, a succinic acid ester, a maleic acid ester, a furmaric acid ester, a citric acid ester, a phenol derivative, e.g. a di-tert-acyl phenol, n-octylphenol alone or in combination of the two or more.

As the binder which may be employed in a constructive layer of the present photosensitive material, there may be mentioned most generally a gelatin, e.g. an alkali-treated gelatin or an acid-treated gelatin and a part of such a gelatin may be used together with a gelatin derivative, e.g., phthalated gelatin, phenylcarbamoylgelatin, albumin, agar, gum arabic, alginic acid, a partially hydrolyzed cellulose derivative, a partially hydrolyzed polyvinyl acetate, a polyacrylamide, a polyvinyl alcohol, a polyvinyl pyrrolidone or a copolymer of said vinyl compounds.

Into an emulsion layer or auxiliary layer in the present photosensitive material may be incorporated other various photographic additives. For instance, there may be suitably employed antifoggants, pigments, image discoloration inhibitors, color stain inhibitors, brightening agent, antistatic agents, surface active agents, plasticizers, wetting agents and others as disclosed in Research Disclosure, No. 17643.

The present photosensitive material can be prepared by coating the respective constructive layers such as emulsion layers and auxiliary layers having incorporated, where necessary, various photographic additives as stated above onto a base treated with corona discharge, flame or ultraviolet irradiation or onto said base via subbing layers or intermediate layers.

As the base which may be advantageously used, there may be mentioned, for example, a Baryta paper, a polyethylene-coated paper, a polypropylene synthetic paper, a transparent base having a reflective layer or using a reflective member, e.g., a glass plate, cellulose acetate, cellulose nitrate or a polyester film, e.g., polyethylene terephthalate, a polyamide film, a polycarbonate film, a polystyrene film and the like. These bases may be suitably selected depending upon purposes for use of photosensitive materials.

For coating the emulsion layers and other constructive layers which may be employed in this invention, there may be applied a variety of coating methods such as chipping coating, air-doctor coating, curtain coating, hopper coating and the like. Also, simultaneous coating of two or more layers may be applied according to the method disclosed in U.S. Pat. Nos. 2,761,791 and 2,941,898.

In this invention, coating location of respective emulsion layers may be suitably determined; for instance, a blue-sensitive emulsion layer, a green-sensitive emulsion layer, a red-sensitive emulsion layer may be in turn located from a base side or a red-sensitive emulsion layer, a green-sensitive layer, a blue-sensitive emulsion layer may be in turn located from a base side.

For such constructive layers, there may be similarly applicable as a binding agent those hydrophilic colloids which may be employed for the above emulsion and also various photographic additives, which may be incorporated into emulsion layers as stated above, may be similarly included into the layer.

With regard to the emulsion layer most distant from a base, an ultraviolet absorbing agent layer may be placed as an adjacent layer distant from a base or, where necessary, said ultraviolet absorbing agent layer may be placed as a layer closer to a base. In the former case, a protective layer substantially composed of gelatin solely may be preferably placed as the most upper layer.

Where the present invention is applied to a color photographic material for printing, said photosensitive material is exposed through a negative photosensitive material having an image composed of a coupling product and then subjected to color developing process.

Color development may be carried out according to a conventional color developing method.

Namely, processing is first effected with a color developing solution containing a color developing agent or a color developing agent or a precursor thereof may be incorporated into a photosensitive material and processed with the so-called activator solution.

Thereafter, bleach step and fix step may be usually effected in a conventional manner. In this case, color developing step with a color developing solution or activator solution, bleach step and fix step may be independently effected, but, instead of any two or more steps independently effected, a processing solution having those functions may be applied once, i.e., in a single bath. For instance, there may be mentioned a single bath processing method wherein a bleaching agent or a fixing agent as mentioned below is added to a color developing solution or an activator solution or a method wherein a bleach-fix bath containing both bleaching agent and fixing agent may be applied after color developing step and so on.

Also, immediately after processed with a color developing solution or an activator solution, processing may be effected with a bleach-fix bath to make desilvering, and and acidic stop step may be effected between a color developing step and a bleach-fix step. As the acidic stop bath, there may be used an aqueous solution of acetic acid, citric acid and others. If further required, there may be used steps of pre-hardening, neutralizing, washing, stabilizing and so on.

By such color developing process, a dye image can be formed by a coupling reaction in a print color photosensitive material.

As the color developing agent for the present photosensitive material, an aromatic primary amine color developing agent is representative. As said color developing agent, ther may be mentioned aminophenol and p-phenylenediamine derivatives, which may be applied either of a free state or as their hydrochloride, sulfate or organic acid salts, e.g., p-toluenesulfonate, tetraphenylborate, p-(tert-octyl)benzenesulfonate and the like. Representative examples of said aromatic primary amine color developing agent may include o-aminophenol, p-aminophenol, 5-amino-2-oxytoluene, 2-amino-3-oxytoluene, 2-oxy-3-amino-1,4-dimethylbenzene, N,N-diethyl-p-phenylenediamine hydrochloride, N-methyl-p-phenylenediamine hydrochloride, N,N-dimethyl-p-phenylenediamine hydrochloride, N-ethyl-N-β-methanesulfonaminoethyl-3-methyl-4-aminoaniline and its sulfate, N-ethyl-N-β-hydroxyethylaminoaniline, N,N-diethyl-3-(β-methanesulfonamidoethyl)-4-aminoaniline hydrochloride, 4-amino-N-(2-methoxyethyl)-N-ethyl-3-methylaniline p-toluenesulfonate, N-ethyl-N-β-methanesulfonamidoethyl-3-methyl-4-aminoaniline tetraphenylborate, 4-amino-N-(2-methoxyethyl)-N-ethyl-3-methylaniline tetraphenylborate, p-morpholinoaniline, p-piperizinoaniline, 4-amino-N,N-diethyl-3-chloroaniline and the like.

In some cases, the present photosensitive material may include a precursor of a color developing agent. The color developing agent precursor is meant to be a compound capable of producing a color developing agent under alkaline condition; for example, a Shiff-base type precursor of an aromatic aldehyde derivative, a polyvalent metal ion complex precursor, a phthalimide derivative precursor, a phosphoramide derivative precursor, a sugar amine reaction product precursor, a urethane type precursor and others. These precursors are disclosed, for example, in U.S. Pat. Nos. 3,342,599, 3,507,114, 2,695,238, 3,719,492, British Pat. No. 803,783, Japanese Patent Laid-open Application Nos. 135628/1978, 79035/1979, Reseach Disclosure Nos. 15159, 12146, 13924.

The aromatic primary amine color developing agent is included in a color developing solution usually at about 1 to 20 g/l and, if said agent is to be included as a precursor, said agent may be included at about 0.5 to 3 moles per one mole of a silver halide.

The color developing solution or activator solution to be used for this invention may further include a water-soluble brightening agent at about 0.1 to 10 g/l.

The color developing solution or activator solution may contain an alkali agent such as potassium hydroxide, sodium hydroxide, sodium carbonate, potassium carbonate, sodium tertiary phosphate, potassium tertiary phosphate; a bromide salt such as sodium bromide, potassium bromide, ammonium bromide; a sulfite such as sodium sulfite, potassium sulfite and the like. Further, there may be included, where necessary, a well-known development retarder such as a thiocyanate, e.g., sodium thiocyanate, potassium thiocyanate, ammonium thiocyanate, a chloride, e.g., ammonium chloride, potassium chloride, sodium chloride; an organic solvent such as ethylene glycol, diethylene glycol, methanol, ethanol, n-butanol, benzyl alcohol, acetone, dimethylformamide; an amine such as hydroxylamine, ethanolamine, ethylenediamine, diethanolamine; a hard water softening agent such as sodium hexametaphosphate, sodium tripolyphosphate, ethylenediaminetetracetic acid, diethylenetriamine penta acetic acid and the like.

The color developing solution or activator solution may further include an auxiliary developing agent. As the auxiliary developing agent, there may be preferably mentioned a 1-aryl-3-pyrazolidone derivative and used a range of 1 mg to 1 g per liter, preferably 10 to 500 mg/l. As representative auxiliary developing agent, there may be mentioned 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, 4-methyl-4-hydroxymethyl-1-(p-tolyl)-3-pyrazolidone and the like.

The color developing solution or activator solution which may be employed in this invention is kept alkaline in a conventional manner and its hydroxyl ion concentration may be suitably selected depending upon the sort, composition, object and use of the negative photosensitive material or print color photosensitive material to be processed and is usally of pH 9.5 to 13.5.

The color developing solution or activator solution to be employed in this invention may be generally applied within a certain temperature range. The temperature range may be suitably selected depending upon the sort, composition, object, use of the present color photosensitive material for print and is preferably 15° to 70° C., more preferably 30° to 50° C.

As the bleaching agent which may be employed for a bleach or bleach-fix bath, there may be used any well-known compounds, for example, an aminopolycarboxylic acid ferric complex, e.g., ethylenediaminetetraacetic acid ferric sodium complex, ethylenediaminetetraacetic acid ferric ammonium complex; a persulfate, e.g., ammonium persulfate, sodium persulfate and the like.

As the fixing agent which may be employed for a fix, or bleach-fix bath, there may be employed any well-known compounds such as a thiosulfate, e.g., sodium thiosulfate, ammonium thiosulfate; a water-soluble sulfur-containing diol, e.g., 3,6-ditho-1,8-octanediol, 3,6,9,12-tetrathia-1,14-tetradecanediol; a water-soluble sulfur-containing dibasic acid, e.g., ethylenebisthioglycolic acid, sodium ethylenebisthioglycolate and the like.

Where this invention is applied to a color photosensitive material, a print can be obtained with excellent sharpness, color reproductivity and whiteness, without fogging, namely a print image quality can be greatly improved. Moreover, a highly sensitized photosensitive material can be prepared and change in sensitivity with time after preparation of said material is very small. The workability can be greatly enhanced.

This invention will be more fully illustrated by way of the following non-limiting examples.

EXAMPLE 1

A color photosensitive material for print, a color photographic paper, was prepared according to the under-mentioned item (1). The photographic papers were subjected to image-like exposure and processed with the under-mentioned color developing solution and bleach-fix bath. Then, performance of the respective color images thus formed was determined.

(1) PREPARATION OF COLOR PHOTOGRAPHIC PAPER

A paper base, the surface of which was coated with a polyethylene containing as a white pigment titanium oxide of an anatase type, was pre-treated with a gelatin subbing layer and then coated in turn with the following layers to form color photographic papers.

Layer 1: Blue-Sensitive Silver Chlorobromide Emulsion Layer

Coated with a silver chlorobromide emulsion containing 5 molar % silver chloride and an emulsified dispersion made by dissolving the following yellow coupler (Y-1) and 2,5-di-tert-octylhydroquinone in dioctyl phthalate.

Layer 2: First Intermediate Layer

Coated with an emulsified dispersion made by dissolving 2,5-di-tert-octylhydroquinone in dioctyl phthalate

Layer 3: Green-Sensitive Silver Chlorobromide Emulsion Layer

Coated with a silver chlorobromide emulsion containing 15 molar % silver chloride and an emulsified dispersion made by dissolving the following magenta coupler (M-1) and 2,5-di-tert-octylhydroquinone in dioctyl phthalate

Layer 4: Second Intermediate Layer

Coated with an emulsified dispersion made by dissolving the following ultraviolet absorbing agent (UV-1) and 2,5-di-tert-octylhydroquinone in dioctyl phthalate.

Layer 5: Red-Sensitive Silver Chlorobromide Emulsion Layer

Coated with a silver chlorobromide emulsion optically sensitized with the sensitizing dye indicated in Table II and an emulsified dispersion made by dissolving the following cyan coupler (C-1) and 2,5-di-tert-octylhydroquinone in dioctyl phthalate.

Layer 6: Protective Layer

Coated with a mixture of mainly gelatin and the hardening agent indicated in Table II.

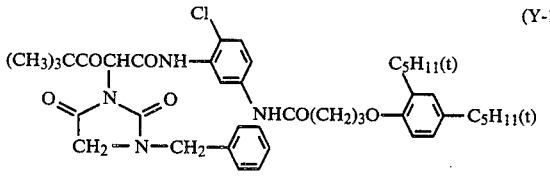

(Y-1)

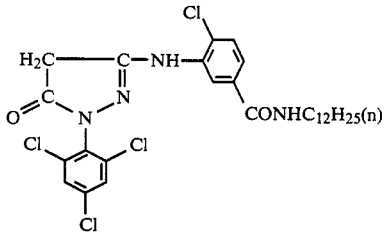

(M-1)

-continued

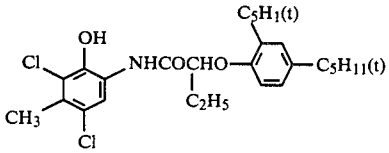

(C-1)

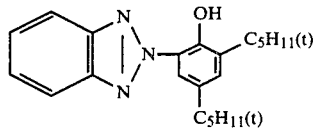

(UV-1)

Amounts of components in each layer (mg per 100 $cm^2$) are shown in Table I.

TABLE I

| | Silver halide emulsion | Ultraviolet absorbing agent or coupler | 2,5-di-tert-octylhydroquinone | Gelatin |
|---|---|---|---|---|
| Layer 1 | (Blue-sensitive silver chlorobromide emulsion) 3 mg as Ag | (Y-1) 8 mg | 0.5 mg | 20 mg |
| Layer 2 | (Intermediate layer) | — | 1.0 mg | 10 mg |
| Layer 3 | (Green-sensitive silver chlorobromide emulsion) 4 mg as Ag | (M-1) 5 mg | 0.5 mg | 15 mg |
| Layer 4 | (Intermediate layer) | (UV-1) 6 mg | 1.0 mg | 10 mg |
| Layer 5 | (Red-sensitive silver chlorobromide emulsion) 3 mg as Ag | (C-1) 4 mg | 0.5 mg | 15 mg |
| Layer 6 | (Protective layer) | — | — | 10 mg |

Twelve samples shown in Table I were prepared by changing the sorts and coated amounts of the silver halide and sensitizing dye in said red-sensitive silver chlorobromide layer and of the hardening agent in said protective layer on the basis of the above-recited layer construction.

TABLE II

| Sample No. | Red-sensitive silver chlorobromide emulsion: Silver chloride content in silver halide (mol. %) | Red-sensitive silver chlorobromide emulsion: Sensitizing dye ($10^{-4}$ mol./Ag mol.) | Protective layer Hardening agent |
|---|---|---|---|
| 1 | 10 | Illustrated compd. (Ia-1) | (H-1) 1.5 mg** |
| 2 | 25 | Illustrated compd. (Ia-1) | " |
| 3 | 50 | Illustrated compd. (Ia-1) | " |
| 4 | 10 | Illustrated compd. (Ia-1) | Illustrated compd. (II-1) 0.75 mg |
| 5* | 25 | Illustrated compd. (Ia-1) | Illustrated compd. (II-1) 0.75 mg |
| 6* | 50 | Illustrated compd. (Ia-1) | Illustrated compd. (II-1) 0.75 mg |
| 7 | 10 | D-1** | (H-1) 1.5 mg** |
| 8 | 25 | " | " |
| 9 | 50 | " | " |
| 10* | 25 | Illustrated compd. (Ia-11) | Illutrated compd. (II-1) 1.5 mg |
| 11* | 25 | Illustrated compd. (Ia-14) | Illutrated compd. (II-1) 1.5 mg |
| 12* | 25 | Illustrated | Illutrated compd. (II-2) |

TABLE II-continued

| Sample No. | Red-sensitive silver chlorobromide emulsion: Silver chloride content in silver halide (mol. %) | Sensitizing dye ($10^{-4}$ mol./Ag mol.) | Protective layer Hardening agent |
|---|---|---|---|
| | | compd. (Ia-1) | 1.5 mg |

*: This invention
**: Comparative
(Note)
(H-1): Comparative hardening agent
$C\equiv CH_2SO_2CH=CH_2)_4$
(D-1): Comparative sensitizing dye

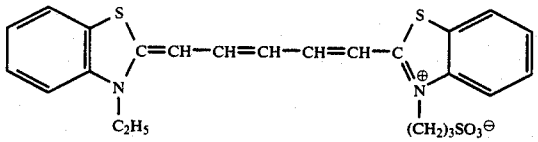

The Sample Nos. 1 to 12 thus prepared were evaluated as seen below.

A. INFRARED SENSOR FOGGING

The sample was exposed for 5 minutes to a light source of Sharp infrared emission diode GL-350 (of a gallium-arsenic type) at a 5 mm distance, the exposed sample was treated as seen below and a cyan concentration was measured by means of Gretag D-122 type densitometer.

| Processing steps (at 32.8° C.) | Processing time |
|---|---|
| Color development | 3 min. 30 sec. |
| Bleach-fix | 1 min. 30 sec. |
| Washing | 3 min. 30 sec. |
| Drying | 1 min. |

FORMULATION OF COLOR DEVELOPING AGENT

N-Ethyl-N-β-methanesulfonamidoethyl-3-methyl-4-aminoaniline sulfate: 4.0 g
Hydroxylamine·sulfate: 2.0 g
Potassium carbonate: 25.0 g
Sodium chloride: 0.1 g
Sodium bromide: 0.2 g
Anhydrous sodium sulfite: 2.0 g
Benzyl alcohol: 10.0 ml
Polyethylene glycol (Average degree of polymerization 400): 3.0 ml
Water added to make up 1 liter and adjusted to pH 10.0 with sodium hydroxide:

FORMULATION OF BLEACH-FIX SOLUTION (Ethylenediaminetetraacetato)iron sodium salt: 60.0 g
Ammonium thiosulfate: 100.0 g
Sodium bisulfite: 20.0 g
Sodium metabisulfite: 5.0 g
Water added to make up 1 liter and adjusted to pH 7.0 with sulfuric acid:
Oxidation-reduction potential: −70 mV

B. SENSITIVITY AND CHANGE IN SENSITIVITY WITH TIME

Sample was allowed to stand under the condition of 25° C. and 60% over one month and changes in sensitivity before and after lapse of time were measured according to the following method.

Sample was exposured to optical wedge and processed and determined for density in the same manner as in the above A to measure sensitivity.

The results are shown in Table III.

TABLE III

| Sample No. | Property: Infrared sensor fogging | Relative sensitivity: Immediately after | Relative sensitivity: Lapse of time (% to sensitivity immediate after) |
|---|---|---|---|
| 1 | 0.15 | 100 | 68 |
| 2 | 0.23 | 161 | 73 |
| 3 | 0.33 | 175 | 75 |
| 4 | 0.02 | 95 | 82 |
| 5* | 0.03 | 158 | 97 |
| 6* | 0.03 | 170 | 98 |
| 7 | 0.03 | 76 | 72 |
| 8 | 0.04 | 105 | 88 |
| 9 | 0.06 | 123 | 91 |
| 10* | 0.01 | 172 | 97 |
| 11* | 0.02 | 166 | 95 |
| 12* | 0.02 | 181 | 95 |

*This invention

If an infrared sensor fogging was less than 0.05 and sensitivity after lapse of time remained at least 95% of initial sensitivity, samples may be practically applicable.

Only samples 5, 6, 10, 11 and 12 according to this invention can meet all requirements.

EXAMPLE 2

The following samples were prepared in the same manner as in Example 1 and performance with regard to pigment image was determined.

A paper base was surface-coated with a polyethylene containing as a white pigment titanium oxide of an anatase-type, pre-processed with a gelatin subbing layer and then coated in turn with the following layers to prepare a color photographic paper.

Layer 1: Blue-Sensitive Silver Chlorobromide Emulsion Layer

Coated with a silver chlorobromide emulsion containing 5 molar % silver chloride and an emulsified dispersion prepared by dissolving the above-indicated yellow coupler (Y-1) and 2,5-di-tert-octylhydroquinone in dioctyl phthalate.

Layer 2: First Intermediate Layer

Coated with an emulsified dispersion prepared by dissolving 2,5-de-tert-octylhydroquinone in dioctyl phthalate.

Layer 3: Green-Sensitive Silver Chlorobromide Emulsion Layer

Coated with a silver chlorobromide emulsion containing 15 molar % silver chloride and an emulsified dispersion prepared by dissolving the above-indicated magneta coupler (M-1) and 2,5-di-tert-octylhydroquinone in dioctyl phthalate.

Layer 4: Second Intermediate Layer

Coated with an emulsified dispersion perpared by dissolving the above-indicated ultraviolet absorbing agent (UV-1) and 2,5-di-tert-octylhydroquinone in dioctyl phthalate.

Layer 5: Red-Sensitive Silver Chlorombromide Emulsion Layer

Coated with a silver chlorobromide emulsion optically sensitized with a sensitizing dye shown in Table IV and an emulsified dispersion prepared by dissolving a cyan coupler (C-1) and 2,5-di-tert-octylhydroquinone in dioctyl phthalate.

Layer 6: Third Intermediate Layer

Coated with an emulsified dispersion prepared by dissolving the above-indicated ultraviolet absorbing agent and 2,5-di-tert-octylhydroquinone in dioctyl phthalate.

Layer 7: Protective Layer

Coated with a mixture of mainly gelatin and the hardening agent indicated in Table IV.

TABLE IV

| Sample No. | AgCl/Agx (mol. %) | Sensitizing dye ($10^{-4}$ mol./Ag mol.) | Hardening agent (mg) |
|---|---|---|---|
| 13 | 10 | (Ia-1) | H-1(1.7) |
| 14 | 30 | " | " |
| 15 | 10 | " | II-1(0.85) |
| 16* | 30 | " | " |
| 17 | 10 | (D-1) | " |
| 18 | 30 | " | " |
| 19* | " | (Ia-1) | II-2(1.7) |
| 20* | " | " | " |
| 21* | " | " | II-4 |
| 22* | " | " | III-2 |
| 23* | " | (Ia-6) | II-2 |
| 24* | " | (Ia-15) | " |

*This invention

The above samples were tested in the same manner as in Example 1 and the results are shown in Table V.

TABLE V

| Sample No. | Infrared sensor fogging | Initial sensitivity | Sensitivity with time (%) |
|---|---|---|---|
| 13 | 0.13 | 88 | 68 |
| 14 | 0.20 | 153 | 70 |
| 15 | 0.01 | 80 | 78 |
| 16* | 0.02 | 149 | 99 |
| 17 | 0.02 | 81 | 65 |
| 18 | 0.03 | 163 | 68 |
| 19* | 0.02 | 153 | 95 |
| 20* | 0.01 | 160 | 98 |
| 21* | 0.00 | 172 | 95 |
| 22* | 0.03 | 158 | 97 |
| 23* | 0.04 | 175 | 100 |
| 24* | 0.02 | 164 | 98 |

*This invention

The samples 16 and 19 to 24 according to this invention showed less infrared sensor fogging, as well as higher sensitivity and at least 95% of initial sensitivity after lapse of time.

EXAMPLE 3

A color photosensitive material for printing, a color photographic paper, was prepared according to the under-mentioned item (2). The photographic papers were subjected to image-like exposure and processed with the under-mentioned color developing solution and bleach-fix bath. Then, performance of the respective color images thus formed was determined.

(2) PREPARATION OF COLOR PHOTOGRAPHIC PAPER

Color photographic papers were prepared according to the same process as in the Example 1, (1), except that the layers were coated as stated below.

Layer 1: Blue-Sensitive Silver Chlorobromide Emulsion Layer

Coated in the same manner as in the Layer 1 of Example 1

Layer 2: First Intermediate Layer

Coated in the same manner as in the Layer 2 of Example 1

Layer 3: Green-Sensitive Silver Chlorobromide Emulsion Layer

Coated in the same manner as in the Layer 3 of Example 1

Layer 4: Second Intermediate Layer

Coated in the same manner as in the Layer 4 of Example 1

Layer 5: Red-Sensitive Silver Chlorobromide Emulsion Layer

Coated with a silver chlorobromide emulsion as shown in Table VI and an emulsified dispersion prepared by dissolving the above-indicated cyan coupler (C-1) and 2,5-di-tert-octylhydroquinone in dioctyl phthalate with an antiirradiation dye as shown in Table VI.

Layer 6: Protective Layer

Coated with a mixture of mainly gelatin and a hardening agent as shown in Table VI. Amounts of components in each layer (mg per 100 $cm^2$) are the same as shown in Table I.

Eleven samples shown in Table VI were prepared by changing the sorts and coated amounts of the silver halide, antiirradiation dye and hardening agent in the protective layer on the basis of the above-recited layer contruction.

TABLE VI

| | Red-sensitive silver chlorobromide emulsion | | |
|---|---|---|---|
| Sample No. | Silver chloride content in silver halide (mol. %) | Antiirradiation dye | Protective layer Hardening agent |
| 25 | 10 mol % | Illustrated Compd. (Ib-1) 0.3 mg | (H-1) 1.5 mg |
| 26 | 25 mol % | Illustrated Compd. (Ib-1) 0.3 mg | (H-1) 1.5 mg |
| 27 | 50 mol % | Illustrated Compd. (Ib-1) 0.3 mg | (H-1) 1.5 mg |
| 28 | 10 mol % | Illustrated Compd. (Ib-1) 0.3 mg | (II-1) 0.75 mg |
| 29* | 25 mol % | Illustrated Compd. (Ib-1) 0.3 mg | (II-1) 0.75 mg |
| 30* | 50 mol % | Illustrated Compd. (Ib-1) 0.3 mg | (II-1) 0.75 mg |
| 31 | 10 mol % | Illustrated compd. (A-1) 0.1 mg | (II-1) 0.75 mg |
| 32 | 25 mol % | Illustrated compd. (A-1) 0.1 mg | (II-1) 0.75 mg |
| 33 | 50 mol % | Illustrated compd. (A-1) 0.1 mg | (II-1) 0.75 mg |
| 34* | 25 mol % | Illustrated compd. (Ib-3) 0.3 mg | (II-1) 0.75 mg |
| 35* | 25 mol % | Illustrated compd. | (II-2) 1.5 mg |

TABLE VI-continued

| Sample No. | Red-sensitive silver chlorobromide emulsion: Silver chloride content in silver halide (mol. %) | Antiirradiation dye | Protective layer Hardening agent |
|---|---|---|---|
| | | (Ib-1) 0.3 mg | |

*This invention
(H-1): Comparative hardening agent was the same as above
(A-1)

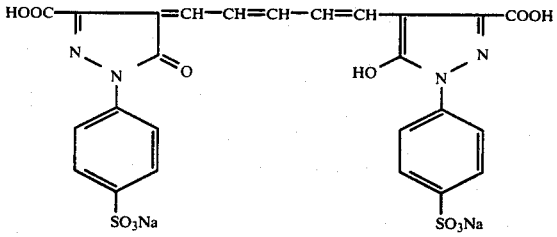

The samples Nos. 24 to 47 thus prepared were evaluated as shown below.

C. FOGGING

The unexposed sample was processed as shown below and a cyan concentration was measured by means of Gretag D-122 type densitometer. Processing steps and processing time were all the same as applied in Example 1. Formulation of color developing agent was the same as applied in Example 1. Also, formulation of bleach-fix solution was the same as applied in Example 1.

D. STAIN WITH ANTIIRRADIATION DYE REMAINED IN SAMPLE

The same experiment as shown in the above C was carried out except that the N-ethyl-N-β-methanesulfonic acid amidoethyl-3-methyl-4-aminoaniline.sulfate was omitted from the color developing agent.

E. CHANGE IN SENSITIVITY WITH TIME

Sample was allowed to stand under the condition of 25° C. and 60% over one month and changes in sensitivity before and after lapse of time were measured according to the following method. Sample was exposed to optical wedge and processed and determined for density in the same manner as in the above C to measure sensitivity.

The results are shown in Table VII.

TABLE VII

| Sample No. | Whiteness: C. fogging | Whiteness: D. stain | E. Sensitivity after lapse of time/ Sensitivity before lapse of time |
|---|---|---|---|
| 25 | 0.004 | 0.001 | 85% |
| 26 | 0.008 | 0.001 | 96 |
| 27 | 0.011 | 0.001 | 98 |
| 28 | 0.004 | 0.002 | 78 |
| 29* | 0.004 | 0.002 | 95 |
| 30* | 0.005 | 0.002 | 97 |
| 31 | 0.008 | 0.007 | 76 |
| 32 | 0.010 | 0.008 | 95 |
| 33 | 0.010 | 0.008 | 96 |
| 34* | 0.004 | 0.001 | 95 |
| 35* | 0.004 | 0.002 | 98 |

*This invention

In a color sensitive material for print, coloration on a white ground in the above C could be accepted if up to 0.005, but whiteness would be damaged if over 0.005. Moreover, change in sensitivity before and after lapse of time could be accepted if within 5% of initial sensitivity (that is, at least 95%), but yield in printing would be greatly lowered if over 5% (that is, less than 95%).

It can be seen that Sample Nos. 29, 30, 34 and 35 according to this invention can meet the requirements for both properties.

EXAMPLE 4

The following samples were prepared in the same manner as in Example 3 and performance with regard to pigment image was determined.

A color photographic paper was prepared according to the same procedures as in Example 2 except that the following layers were applied.

Layer 1: Blue-Sensitive Silver Chlorobromide Emulsion Layer

Coated in the same manner as in Example 2, the layer 1

Layer 2: First Intermediate layer

Coated in the same manner as in Example 2, the layer 2

Layer 3: Green-Sensitive Silver Chlorobromide Emulsion Layer

Coated in the same manner as in Example 2, the layer 3

Layer 4: Second Intermediate Layer

Coated in the same manner as in Example 2, the layer 4

Layer 5: Red-Sensitive Silver Chlorobromide Emulsion Layer

Coated with a silver chlorobromide emulsion as shown in Table IX and an emulsified dispersion prepared by dissolving the cyan coupler (C-1) and 2,5-di-tert-octylhydroquinone in dioctyl phthalate.

Layer 6: Third Intermediate Layer

Coated with an emulsified dispersion prepared by dissolving the ultraviolet absorbing agent (UV-1) and 2,5-di-tert-octylhydroquinone in dioctyl phthalate and an antiirradiation dye shown in Table IX.

Layer 7: Protective Layer

Coated with a mixture of mainly gelatin and a hardening agent shown in Table IX.

Amounts of main components in each layer (mg per 100 cm²) are shown in Table VIII.

TABLE VIII

| | Silver halide emulsion | Coupler and ultraviolet absorber | 2,5-di-tert-octylhydro-quinone | Gelatin |
|---|---|---|---|---|
| Layer 1 | (Blue-sensitive silver chlorobromide emulsion) 3 mg as Ag | (Y-1) 8 mg | 0.5 mg | 20 |
| Layer 2 | (Intermediate layer) | — | 1.0 mg | 10 |
| Layer 3 | (Green-sensitive silver chlorobromide emulsion) 4 mg as Ag | (M-1) 5 mg | 0.5 mg | 15 |
| Layer 4 | (Intermediate layer) | (UV-1) 6 mg | 1.0 mg | 10 |
| Layer 5 | (Red-sensitive silver chlorobromide emulsion) 3 mg as Ag | (C-1) 4 mg | 0.5 mg | 15 |
| Layer | (Intermediate layer) | (UV-1) | 0.5 mg | 10 |

TABLE VIII-continued

| | Silver halide emulsion | Coupler and ultraviolet absorber | 2,5-di-tert-octylhydro-quinone | Gelatin |
|---|---|---|---|---|
| 6 | | 3 mg | | |
| Layer 7 | (Protective layer) | — | — | 10 |

The following twelve samples were prepared by changing the sorts and coated amounts of the silver halide in said red-sensitive silver chlorobromide emulsion, the antiirradition dye in said third intermediate layer and the hardening agent in said protective layer on the basis of the above layer construction.

TABLE IX

| Sample No. | Red-sensitive silver chlorobromide emulsion: Silver chloride content in silver halide (mol. %) | Antiirradiation dye | | Protective layer Hardening agent | |
|---|---|---|---|---|---|
| 36 | 10 | (Ib-1) | 0.3 mg | (H-1) | 1.7 mg |
| 37 | 30 | (Ib-1) | 0.3 mg | (H-1) | 1.7 mg |
| 38 | 10 | (Ib-1) | 0.3 mg | (II-1) | 0.85 mg |
| 39* | 30 | (Ib-1) | 0.3 mg | (II-1) | 0.85 mg |
| 40 | 10 | (A-1) | 0.3 mg | (II-1) | 0.85 mg |
| 41 | 30 | (A-1) | 0.3 mg | (II-1) | 0.85 mg |
| 42* | 30 | (Ib-1) | 0.3 mg | (II-2) | 1.7 mg |
| 43* | 30 | (Ib-1) | 0.3 mg | (III-2) | 1.7 mg |
| 44* | 30 | (Ib-1) | 0.3 mg | (III-6) | 1.7 mg |
| 45* | 30 | (Ib-3) | 0.3 mg | (II-1) | 0.85 mg |
| 46* | 30 | (Ib-4) | 0.3 mg | (II-1) | 0.85 mg |
| 47* | 30 | (Ib-15) | 0.3 mg | (II-1) | 0.85 mg |

*This invention

The samples Nos. 36 to 47 were evaluated in the same manner as in Example 3. The results are shown in Table X.

TABLE X

| Sample No. | Whiteness: C. fogging | D. stain | E. Sensitivity after lapse of time/ Sensitivity before lapse of time |
|---|---|---|---|
| 36 | 0.004 | 0.001 | 82% |
| 37 | 0.011 | 0.001 | 97% |
| 38 | 0.004 | 0.002 | 70% |
| 39* | 0.004 | 0.002 | 96% |
| 40 | 0.010 | 0.009 | 72% |
| 41 | 0.011 | 0.010 | 93% |
| 42* | 0.004 | 0.002 | 95% |
| 43* | 0.004 | 0.002 | 96% |
| 44* | 0.005 | 0.002 | 95% |
| 45* | 0.003 | 0.002 | 97% |
| 46* | 0.005 | 0.003 | 97% |
| 47* | 0.004 | 0.002 | 95% |

*This invention

It can be seen that the Sample Nos. 39 and 42 to 47 exert excellent performance in both whiteness and low change in sensitivity with time after preparation of the photosensitive material.

We claim:

1. A silver halide color photographic material having one layer of silver halide emulsion layers containing a silver halide having a silver chloride content of not less than 25 molar % and a color coupler, characterized in that at least one of said silver halide emulsion layers contains a silver halide sensitized with a compound having at least one of the following formula (Ia), and the following formula (Ib) and is hardened with a compound having at least one of the following formula (II) and a compound having the formula (III);

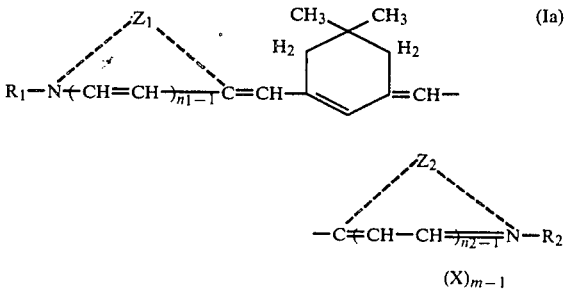

(Ia)

wherein each of $R_1$ and $R_2$ represents an alkyl group; each of $Z_1$ and $Z_2$ represents a nonmetallic atom group for forming a 5- or 6-membered nitrogen-containing heterocyclic ring; X represents an anion; each of $n_1$ and $n_2$ is 1 or 2; and m is 1 or 2 provided that, when an inner salt is formed, m is 1;

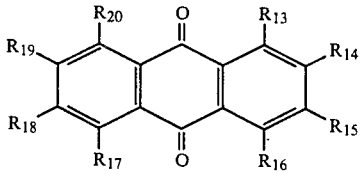

(Ib)

wherein each of $R_{13}$, $R_{16}$, $R_{17}$ and $R_{20}$ represents a hydrogen atom, a hydroxy group, a group of —OR of a group of

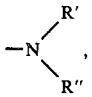

in which R is an alkyl or aryl group and each of R′ and R″ is a hydrogen atom or an alkyl or aryl group having at least one of a sulfonic acid group or a carboxylic acid group; and each of $R_{14}$, $R_{15}$, $R_{18}$ and $R_{19}$ represents a hydrogen atom, a sulfonic acid group, a carboxylic acid group or an alkyl or aryl group having at least one of a sulfonic acid group or a carboxylic acid group;

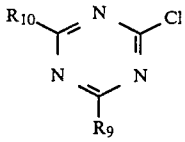

(II)

wherein $R_9$ represents a chlorine atom, a hydroxyl group, an alkyl group, an alkoxy group, a group of

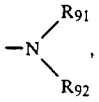

in which each of $R_{91}$ and $R_{92}$ is a hydrogen atom, an alkyl group or an aryl group, a group of 13 $NHCOR_{93}$, in which $R_{93}$ is a hydrogen atom, an alkyl group, an aryl group or an alkylthio group, or a group of —OH, in which M is a monovalent metal atom; and $R_{10}$ is the same as $R_9$ except for a chlorine atom;

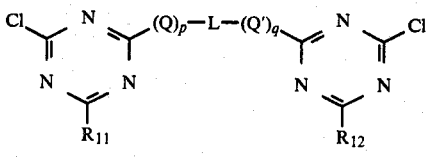

(III)

wherein each of $R_{11}$ and $R_{12}$ represents a chlorine atom, a hydroxyl group, an alkyl group, an alkoxy group or a group of —OM, in which M is as defined above; each of Q and Q' represents a binding group of —O—, —S— or —NH—; L represents an alkylene group of an arylene group; and each of p and q is 0 or 1.

2. A silver halide color photographic material as claimed in claim 1, wherein said compound (Ia) is applied to a red-sensitive silver halide.

3. A silver halide color photographic material as claimed in claim 1, wherein said compound (Ib) is present and is applied at a ratio of 1 to 100 mg per $m^2$ of the photographic material.

4. A silver halide color photographic material as claimed in claim 1, wherein said compound (II) or (III) is applied at a ratio of 1 to 100 mg per gram of gelatin.

5. A silver halide color photographic material as claimed in claim 1, wherein said silver halide is composed of 25 to 60 molar % silver chloride and 40 to 75 molar % silver bromide.

6. A silver halide color photographic material as claimed in claim 1, wherein there is further applied a noble metal, sulfur, selenium or reduction chemical sensitizing agent.

7. A silver halide color photographic material as claimed in claim 1, wherein three blue-, green- and red-sensitive silver halide emulsions having different spectral sensitivities are coated onto a reflective base and each of said emulsion layers contains one of three nondiffusion yellow, magneta and cyan couplers, respectively.

8. A silver halide color photographic material as claimed in in claim 1, wherein said compound (1a) is present and is applied at a ratio of $1\times10^{-3}$ to $1\times10^{-5}$ mole per mole of the silver halide.

9. A silver halide color photographic material as claimed in claim 2, wherein said compound (1a) is selected from the group consisting of

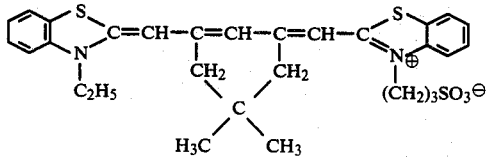

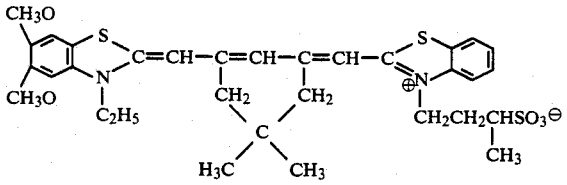

-continued

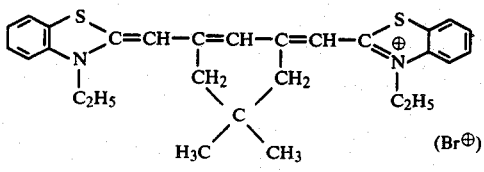

(Br⊕)

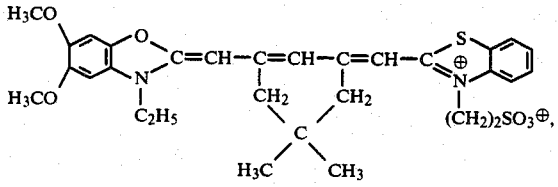

and

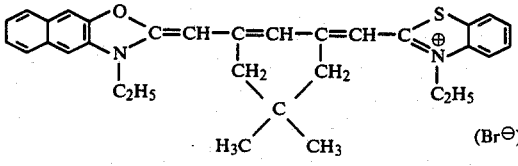

(Br⊖).

10. A silver halide color photographic material as claimed in claim 9, wherein said compound (1a) is

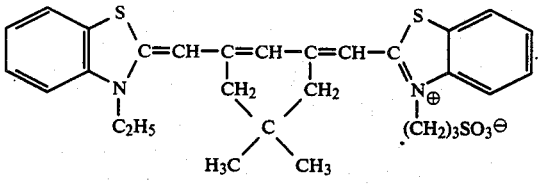

11. A silver halide color photographic material as claimed in claim 3, wherein said compound (1b) is selected from the group consisting of

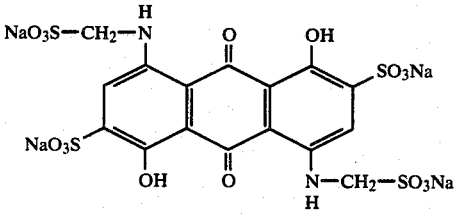

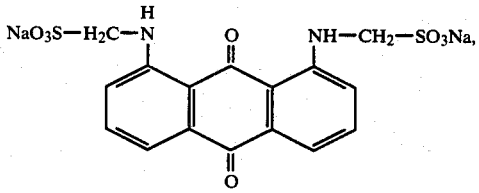

and

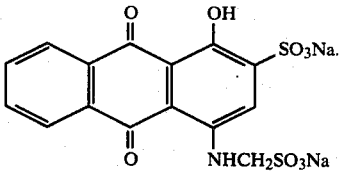

12. A silver halide color photographic material as claimed in claim 11, wherein said compound is

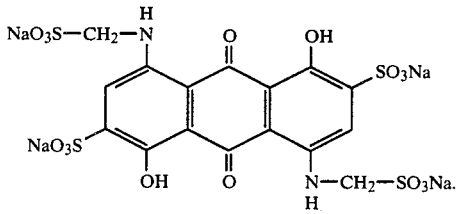

13. A silver halide color photographic materials as claimed in claim 4, wherein said hardener II is present and is selected from the group consisting of

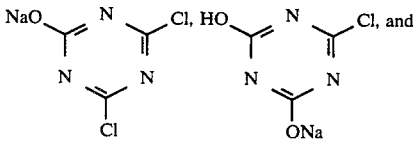

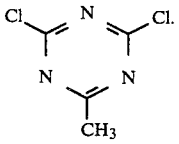

14. A silver halide color photographic material as claimed in claim 13, wherein said hardener II is

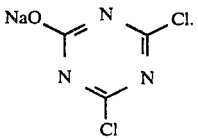

15. A silver halide color photographic material as claimed in claim 13, wherein said hardener II is

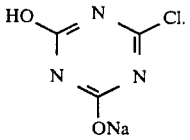

16. A silver halide color photographic material as claimed in claim 4, wherein said hardener III is present and is selected from the gorup consisting of

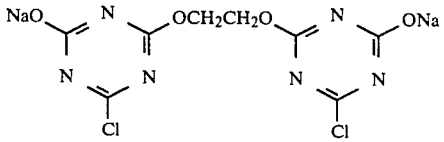

and

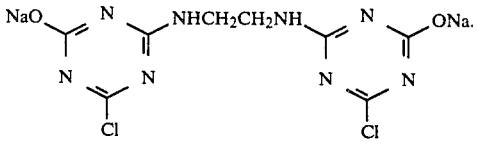

* * * * *